US009203154B2

(12) United States Patent
Korva

(10) Patent No.: US 9,203,154 B2
(45) Date of Patent: Dec. 1, 2015

(54) MULTI-RESONANCE ANTENNA, ANTENNA MODULE, RADIO DEVICE AND METHODS

(75) Inventor: Heikki Korva, Tupos (FI)

(73) Assignee: Pulse Finland Oy, Kempele (FI)

( * ) Notice: Subject to any disclaimer, the term of this patent is extended or adjusted under 35 U.S.C. 154(b) by 247 days.

(21) Appl. No.: 13/989,404

(22) PCT Filed: Jan. 12, 2012

(86) PCT No.: PCT/FI2012/050025

§ 371 (c)(1),
(2), (4) Date: May 23, 2013

(87) PCT Pub. No.: WO2012/101320

PCT Pub. Date: Aug. 2, 2012

(65) Prior Publication Data

US 2013/0241779 A1 Sep. 19, 2013

(30) Foreign Application Priority Data

Jan. 25, 2011 (FI) ..... 20115072

(51) Int. Cl.
*H01Q 1/24* (2006.01)
*H01Q 9/04* (2006.01)
(Continued)

(52) U.S. Cl.
CPC ..... *H01Q 9/04* (2013.01); *H01Q 1/243* (2013.01); *H01Q 5/378* (2015.01); *H01Q 9/42* (2013.01)

(58) Field of Classification Search
CPC ..... H01Q 1/243; H01Q 5/378; H01Q 9/04; H01Q 9/42
USPC ..... 343/702, 700 MS, 846
See application file for complete search history.

(56) References Cited

U.S. PATENT DOCUMENTS 2,745,102 A 5/1956 Norgorden
3,938,161 A 2/1976 Sanford
(Continued)

FOREIGN PATENT DOCUMENTS

CN 1316797 10/2007
DE 10104862 8/2002
(Continued)

OTHER PUBLICATIONS

"An Adaptive Microstrip Patch Antenna For Use in Portable Transceivers", Rostbakken et al., Vehicular Technology Conference, 1996, Mobile Technology For The Human Race, pp. 339-343.
(Continued)

*Primary Examiner* — Hoanganh Le
(74) *Attorney, Agent, or Firm* — Gazdzinski & Associates PC

(57) ABSTRACT

An internal dual band antenna meant for small radio devices. In one embodiment, the antenna contains two radiators and a parasite element, which is shared between them. The parasite element is implemented on three sides of the antenna module, which are perpendicular to the side where the two radiators are implemented. The short-circuit conductor of the parasite element extends close to the supply point/points of the antenna on the circuit board of the radio device and is connected to the ground plane of the radio device. The antenna structure is dimensioned such that the two resonance frequencies on both functional bands are at a lower frequency than the resonance frequencies of the actual radiators. Accordingly, both the lower and upper frequency band is widened. The shape of the parasite element does not weaken the adaptation of the antenna in either functional band.

23 Claims, 7 Drawing Sheets

Figure 1A:
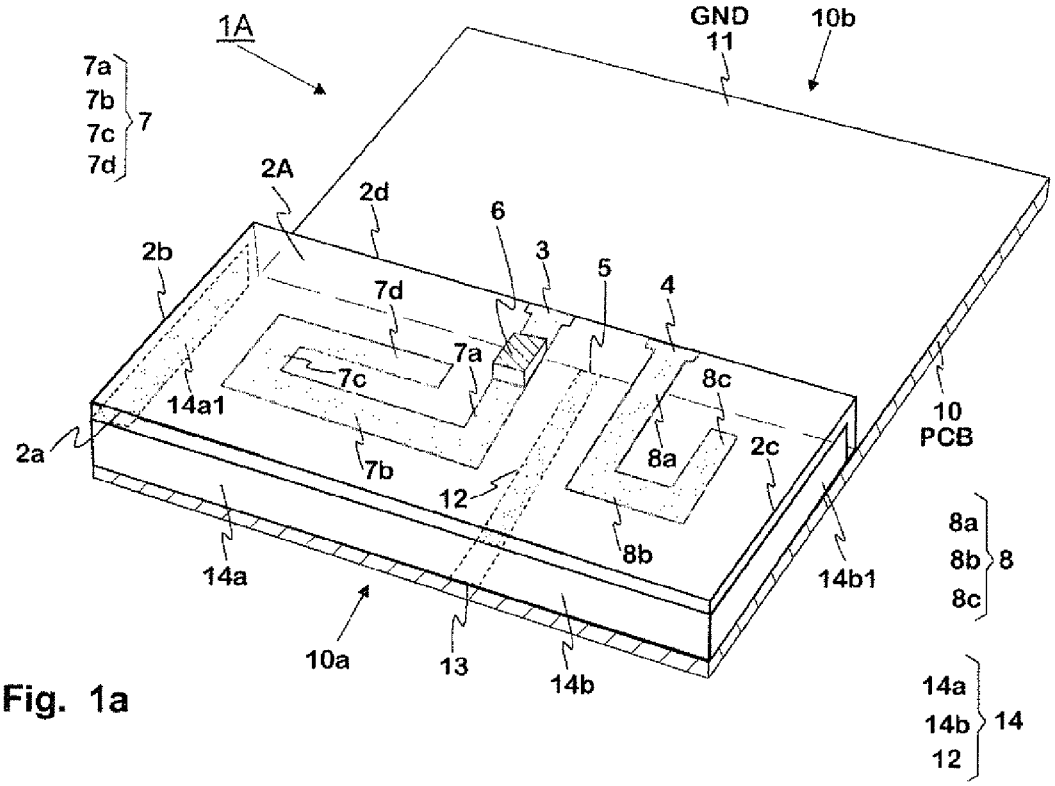

(51) Int. Cl.
*H01Q 9/42* (2006.01)
*H01Q 5/378* (2015.01)

(56) References Cited

U.S. PATENT DOCUMENTS 4,004,228 A 1/1977 Mullett
4,028,652 A 6/1977 Wakino et al.
4,031,468 A 6/1977 Ziebell et al.
4,054,874 A 10/1977 Oltman
4,069,483 A 1/1978 Kaloi
4,123,756 A 10/1978 Nagata et al.
4,123,758 A 10/1978 Shibano et al.
4,131,893 A 12/1978 Munson et al.
4,201,960 A 5/1980 Skutta et al.
4,255,729 A 3/1981 Fukasawa et al.
4,313,121 A 1/1982 Campbell et al.
4,356,492 A 10/1982 Kaloi
4,370,657 A 1/1983 Kaloi
4,423,396 A 12/1983 Makimoto et al.
4,431,977 A 2/1984 Sokola et al.
4,546,357 A 10/1985 Laughon et al.
4,559,508 A 12/1985 Nishikawa et al.
4,625,212 A 11/1986 Oda et al.
4,653,889 A 3/1987 Bizouard et al.
4,661,992 A 4/1987 Garay et al.
4,692,726 A 9/1987 Green et al.
4,703,291 A 10/1987 Nishikawa et al.
4,706,050 A 11/1987 Andrews
4,716,391 A 12/1987 Moutrie et al.
4,740,765 A 4/1988 Ishikawa et al.
4,742,562 A 5/1988 Kommrusch
4,761,624 A 8/1988 Igarashi et al.
4,800,348 A 1/1989 Rosar et al.
4,800,392 A 1/1989 Garay et al.
4,821,006 A 4/1989 Ishikawa et al.
4,823,098 A 4/1989 DeMuro et al.
4,827,266 A 5/1989 Sato et al.
4,829,274 A 5/1989 Green et al.
4,835,538 A 5/1989 McKenna et al.
4,835,541 A 5/1989 Johnson et al.
4,862,181 A 8/1989 PonceDeLeon et al.
4,879,533 A 11/1989 De Muro et al.
4,896,124 A 1/1990 Schwent
4,907,006 A 3/1990 Nishikawa et al.
4,954,796 A 9/1990 Green et al.
4,965,537 A 10/1990 Kommrusch
4,977,383 A 12/1990 Niiranen
4,980,694 A 12/1990 Hines
5,016,020 A 5/1991 Simpson
5,017,932 A 5/1991 Ushiyama et al.
5,043,738 A 8/1991 Shapiro et al.
5,047,739 A 9/1991 Kuokkanene
5,053,786 A 10/1991 Silverman et al.
5,057,847 A 10/1991 Vaeisaenen
5,061,939 A 10/1991 Nakase
5,097,236 A 3/1992 Wakino et al.
5,103,197 A 4/1992 Turunen
5,109,536 A 4/1992 Kommrusch
5,155,493 A 10/1992 Thursby et al.
5,157,363 A 10/1992 Puurunen
5,159,303 A 10/1992 Flink
5,166,697 A 11/1992 Viladevall et al.
5,170,173 A 12/1992 Krenz et al.
5,203,021 A 4/1993 Repplinger et al.
5,210,510 A 5/1993 Karsikas
5,210,542 A 5/1993 Pett et al.
5,220,335 A 6/1993 Huang
5,229,777 A 7/1993 Doyle
5,239,279 A 8/1993 Turunen
5,278,528 A 1/1994 Turunen
5,281,326 A 1/1994 Galla
5,298,873 A 3/1994 Ala-Kojola
5,302,924 A 4/1994 Jantunen
5,304,968 A 4/1994 Ohtonen
5,307,036 A 4/1994 Turunen
5,319,328 A 6/1994 Turunen
5,349,315 A 9/1994 Ala-Kojola
5,349,700 A 9/1994 Parker
5,351,023 A 9/1994 Niiranen
5,354,463 A 10/1994 Turunen
5,355,142 A 10/1994 Marshall et al.
5,357,262 A 10/1994 Blaese
5,363,114 A 11/1994 Shoemaker
5,369,782 A 11/1994 Kawano et al.
5,382,959 A 1/1995 Pett et al.
5,386,214 A 1/1995 Sugawara
5,387,886 A 2/1995 Takalo
5,394,162 A 2/1995 Korovesis et al.
RE34,898 E 4/1995 Turunen
5,408,206 A 4/1995 Turunen
5,418,508 A 5/1995 Puurunen
5,432,489 A 7/1995 Yrjola
5,438,697 A 8/1995 Fowler et al.
5,440,315 A 8/1995 Wright et al.
5,442,366 A 8/1995 Sanford
5,444,453 A 8/1995 Lalezari
5,467,065 A 11/1995 Turunen
5,473,295 A 12/1995 Turunen
5,506,554 A 4/1996 Ala-Kojola
5,508,668 A 4/1996 Prokkola
5,510,802 A 4/1996 Tsuru et al.
5,517,683 A 5/1996 Collett et al.
5,521,561 A 5/1996 Yrjola
5,526,003 A 6/1996 Ogawa et al.
5,532,703 A 7/1996 Stephens et al.
5,541,560 A 7/1996 Turunen
5,541,617 A 7/1996 Connolly et al.
5,543,764 A 8/1996 Turunen
5,550,519 A 8/1996 Korpela
5,557,287 A 9/1996 Pottala et al.
5,557,292 A 9/1996 Nygren et al.
5,566,441 A 10/1996 Marsh et al.
5,570,071 A 10/1996 Ervasti
5,585,771 A 12/1996 Ervasti
5,585,810 A 12/1996 Tsuru et al.
5,589,844 A 12/1996 Belcher et al.
5,594,395 A 1/1997 Niiranen
5,604,471 A 2/1997 Rattila
5,627,502 A 5/1997 Ervasti
5,649,316 A 7/1997 Prodhomme et al.
5,668,561 A 9/1997 Perrotta et al.
5,675,301 A 10/1997 Nappa
5,689,221 A 11/1997 Niiranen
5,694,135 A 12/1997 Dikun et al.
5,696,517 A 12/1997 Kawahata et al.
5,703,600 A 12/1997 Burrell et al.
5,709,823 A 1/1998 Hayes et al.
5,711,014 A 1/1998 Crowley et al.
5,717,368 A 2/1998 Niiranen
5,731,749 A 3/1998 Yrjola
5,734,305 A 3/1998 Ervasti
5,734,350 A 3/1998 Deming et al.
5,734,351 A 3/1998 Ojantakanen
5,739,735 A 4/1998 Pyykko
5,742,259 A 4/1998 Annamaa
5,757,327 A 5/1998 Yajima et al.
5,760,746 A 6/1998 Kawahata
5,764,190 A 6/1998 Murch et al.
5,767,809 A 6/1998 Chuang et al.
5,768,217 A 6/1998 Sonoda et al.
5,777,581 A 7/1998 Lilly et al.
5,777,585 A 7/1998 Tsuda et al.
5,793,269 A 8/1998 Ervasti
5,797,084 A 8/1998 Tsuru et al.
5,812,094 A 9/1998 Maldonado
5,815,048 A 9/1998 Ala-Kojola
5,822,705 A 10/1998 Lehtola
5,852,421 A 12/1998 Maldonado
5,861,854 A 1/1999 Kawahata et al.
5,874,926 A 2/1999 Tsuru et al.
5,880,697 A 3/1999 McCarrick et al.
5,886,668 A 3/1999 Pedersen et al.
5,892,490 A 4/1999 Asakura et al.
5,903,820 A 5/1999 Hagstrom

(56) References Cited

U.S. PATENT DOCUMENTS 5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Tadahiko et al.
5,943,016 A 8/1999 Snyder, Jr. et al.
5,952,975 A 9/1999 Pedersen et al.
5,959,583 A 9/1999 Funk
5,963,180 A 10/1999 Leisten
5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.
5,986,608 A 11/1999 Korisch et al.
5,990,848 A 11/1999 Annamaa
5,999,132 A 12/1999 Kitchener et al.
6,005,529 A 12/1999 Hutchinson
6,006,419 A 12/1999 Vandendolder et al.
6,008,764 A 12/1999 Ollikainen
6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.
6,037,848 A 3/2000 Alila
6,043,780 A 3/2000 Funk et al.
6,052,096 A 4/2000 Tsuru et al.
6,072,434 A 6/2000 Papatheodorou
6,078,231 A 6/2000 Pelkonen
6,091,363 A 7/2000 Komatsu et al.
6,091,365 A 7/2000 Anders et al.
6,097,345 A 8/2000 Walton
6,100,849 A 8/2000 Tsubaki et al.
6,121,931 A 9/2000 Levi et al.
6,133,879 A 10/2000 Grangeat et al.
6,134,421 A 10/2000 Lee et al.
6,140,966 A 10/2000 Pankinaho
6,140,973 A 10/2000 Annamaa
6,147,650 A 11/2000 Kawahata et al.
6,157,819 A 12/2000 Vuokko
6,177,908 B1 1/2001 Kawahata
6,185,434 B1 2/2001 Hagstrom
6,190,942 B1 2/2001 Wilm et al.
6,195,049 B1 2/2001 Kim et al.
6,204,826 B1 3/2001 Rutkowski et al.
6,215,376 B1 4/2001 Hagstrom
6,218,989 B1 4/2001 Schneider et al.
6,246,368 B1 6/2001 Deming et al.
6,252,552 B1 6/2001 Tarvas et al.
6,252,554 B1 6/2001 Isohatala
6,255,994 B1 7/2001 Saito
6,268,831 B1 7/2001 Sanford
6,281,848 B1 8/2001 Nagumo et al.
6,295,029 B1 9/2001 Chen et al.
6,297,776 B1 10/2001 Pankinaho
6,304,220 B1 10/2001 Herve et al.
6,308,720 B1 10/2001 Modi
6,316,975 B1 11/2001 O'Toole et al.
6,323,811 B1 11/2001 Tsubaki
6,326,921 B1 12/2001 Egorov et al.
6,337,663 B1 1/2002 Chi-Minh
6,340,954 B1 1/2002 Annamaa et al.
6,342,859 B1 1/2002 Kurz et al.
6,343,208 B1 1/2002 Ying
6,346,914 B1 2/2002 Annamaa
6,348,892 B1 2/2002 Annamaa
6,353,443 B1 3/2002 Ying
6,366,243 B1 4/2002 Isohatala
6,377,827 B1 4/2002 Rydbeck
6,380,905 B1 4/2002 Annamaa
6,396,444 B1 5/2002 Goward
6,404,394 B1 6/2002 Hill
6,417,813 B1 7/2002 Durham et al.
6,421,014 B1 7/2002 Sanad
6,423,915 B1 7/2002 Winter
6,112,108 A1 8/2002 Crowley et al.
6,429,818 B1 8/2002 Johnson et al.
6,452,551 B1 9/2002 Chen
6,452,558 B1 9/2002 Saitou et al.
6,456,249 B1 9/2002 Johnson et al.
6,459,413 B1 10/2002 Tseng et al.
6,462,716 B1 10/2002 Kushihi
6,469,673 B2 10/2002 Kaiponen
6,473,056 B2 10/2002 Annamaa
6,476,767 B2 11/2002 Aoyama et al.
6,476,769 B1 11/2002 Lehtola
6,480,155 B1 11/2002 Eggleston
6,483,462 B2 11/2002 Weinberger
6,498,586 B2 12/2002 Pankinaho
6,501,425 B1 12/2002 Nagumo
6,515,625 B1 2/2003 Johnson
6,518,925 B1 2/2003 Annamaa
6,529,168 B2 3/2003 Mikkola
6,529,749 B1 3/2003 Hayes et al.
6,535,170 B2 3/2003 Sawamura et al.
6,538,604 B1 3/2003 Isohatala
6,538,607 B2 3/2003 Barna
6,542,050 B1 4/2003 Arai et al.
6,549,167 B1 4/2003 Yoon
6,552,686 B2 4/2003 Ollikainen et al.
6,556,812 B1 4/2003 Pennanen et al.
6,566,944 B1 5/2003 Pehlke
6,580,396 B2 6/2003 Lin
6,580,397 B2 6/2003 Kuriyama et al.
6,600,449 B2 7/2003 Onaka
6,603,430 B1 8/2003 Hill et al.
6,606,016 B2 8/2003 Takamine et al.
6,611,235 B2 8/2003 Barna et al.
6,614,400 B2 9/2003 Egorov
6,614,401 B2 9/2003 Onaka et al.
6,614,405 B1 9/2003 Mikkoken
6,634,564 B2 10/2003 Kuramochi
6,636,181 B2 10/2003 Asano
6,639,564 B2 10/2003 Johnson
6,639,701 B1 10/2003 Johnson
6,646,606 B2 11/2003 Mikkola
6,650,294 B2 * 11/2003 Ying et al. ..... 343/700 MS
6,650,295 B2 11/2003 Ollikainen et al.
6,657,593 B2 12/2003 Nagumo et al.
6,657,595 B1 12/2003 Phillips et al.
6,670,926 B2 12/2003 Miyasaka
6,677,903 B2 1/2004 Wang
6,680,705 B2 1/2004 Tan et al.
6,683,573 B2 1/2004 Park
6,693,594 B2 2/2004 Pankinaho et al.
6,717,551 B1 4/2004 Desclos et al.
6,727,857 B2 4/2004 Mikkola
6,734,825 B1 5/2004 Guo et al.
6,734,826 B1 5/2004 Dai et al.
6,738,022 B2 5/2004 Varjakka
6,741,214 B1 5/2004 Kadambi et al.
6,753,813 B2 6/2004 Kushihi
6,759,989 B2 7/2004 Tarvas et al.
6,765,536 B2 7/2004 Phillips et al.
6,774,853 B2 8/2004 Wong et al.
6,781,545 B2 8/2004 Sung
6,801,166 B2 10/2004 Mikkola
6,801,169 B1 10/2004 Chang et al.
6,806,835 B2 10/2004 Iwai
6,819,287 B2 11/2004 Sullivan et al.
6,819,293 B2 11/2004 De Graauw
6,825,818 B2 11/2004 Toncich
6,836,249 B2 12/2004 Kenoun et al.
6,847,329 B2 1/2005 Ikegaya et al.
6,856,293 B2 2/2005 Bordi
6,862,437 B1 3/2005 McNamara
6,862,441 B2 3/2005 Ella
6,873,291 B2 3/2005 Aoyama
6,876,329 B2 4/2005 Milosavljevic
6,882,317 B2 4/2005 Koskiniemi
6,891,507 B2 5/2005 Kushihi et al.
6,897,810 B2 5/2005 Dai et al.
6,900,768 B2 5/2005 Iguchi et al.

(56) References Cited

U.S. PATENT DOCUMENTS 6,903,692 B2 6/2005 Kivekas
6,911,945 B2 6/2005 Korva
6,922,171 B2 7/2005 Annamaa
6,925,689 B2 8/2005 Folkmar
6,927,729 B2 8/2005 Legay
6,937,196 B2 8/2005 Korva
6,950,065 B2 9/2005 Ying et al.
6,950,066 B2 9/2005 Hendler et al.
6,950,068 B2 9/2005 Bordi
6,950,072 B2 9/2005 Miyata et al.
6,952,144 B2 10/2005 Javor
6,952,187 B2 10/2005 Annamaa
6,958,730 B2 10/2005 Nagumo et al.
6,961,544 B1 11/2005 Hagstrom
6,963,308 B2 11/2005 Korva
6,963,310 B2 11/2005 Horita et al.
6,967,618 B2 11/2005 Ojantakanen
6,975,278 B2 12/2005 Song et al.
6,980,158 B2 12/2005 Iguchi et al.
6,985,108 B2 1/2006 Mikkola
6,992,543 B2 1/2006 Luetzelschwab et al.
6,995,710 B2 2/2006 Sugimoto et al.
7,023,341 B2 4/2006 Stilp
7,031,744 B2 4/2006 Kojima et al.
7,034,752 B2 4/2006 Sekiguchi et al.
7,042,403 B2 5/2006 Colburn et al.
7,053,841 B2 5/2006 Ponce De Leon et al.
7,054,671 B2 5/2006 Kaiponen et al.
7,057,560 B2 6/2006 Erkocevic
7,061,430 B2 6/2006 Zheng et al.
7,081,857 B2 7/2006 Kinnunen et al.
7,084,831 B2 8/2006 Takagi et al.
7,099,690 B2 8/2006 Milosavljevic
7,113,133 B2 9/2006 Chen et al.
7,119,749 B2 10/2006 Miyata et al.
7,126,546 B2 10/2006 Annamaa
7,129,893 B2 10/2006 Otaka et al.
7,136,019 B2 11/2006 Mikkola
7,136,020 B2 11/2006 Yamaki
7,142,824 B2 11/2006 Kojima et al.
7,148,847 B2 12/2006 Yuanzhu
7,148,849 B2 12/2006 Lin
7,148,851 B2 12/2006 Takaki et al.
7,170,464 B2 1/2007 Tang et al.
7,176,838 B1 2/2007 Kinezos
7,180,455 B2 2/2007 Oh et al.
7,193,574 B2 3/2007 Chiang et al.
7,205,942 B2 4/2007 Wang et al.
7,215,283 B2 5/2007 Boyle
7,218,280 B2 5/2007 Annamaa
7,218,282 B2 5/2007 Humpfer et al.
7,224,313 B2 5/2007 McKinzie, III et al.
7,230,574 B2 6/2007 Johnson
7,233,775 B2 6/2007 De Graauw
7,237,318 B2 7/2007 Annamaa
7,256,743 B2 8/2007 Korva
7,274,334 B2 9/2007 O'Riordan et al.
7,283,097 B2 10/2007 Wen et al.
7,289,064 B2 10/2007 Cheng
7,292,200 B2 11/2007 Posluszny et al.
7,319,432 B2 1/2008 Andersson
7,330,153 B2 2/2008 Rentz
7,333,067 B2 2/2008 Hung et al.
7,339,528 B2 3/2008 Wang et al.
7,340,286 B2 3/2008 Kempele
7,345,634 B2 3/2008 Ozkar et al.
7,352,326 B2 4/2008 Korva
7,355,270 B2 4/2008 Hasebe et al.
7,358,902 B2 4/2008 Erkocevic
7,375,695 B2 5/2008 Ishizuka et al.
7,381,774 B2 6/2008 Bish et al.
7,382,319 B2 6/2008 Kawahata et al.
7,385,556 B2 6/2008 Chung et al.
7,388,543 B2 6/2008 Vance
7,391,378 B2 6/2008 Mikkola
7,405,702 B2 7/2008 Annamaa et al.
7,417,588 B2 8/2008 Castany et al.
7,423,592 B2 9/2008 Pros et al.
7,432,860 B2 10/2008 Huynh
7,439,929 B2 10/2008 Ozkar
7,443,344 B2 10/2008 Boyle
7,468,700 B2 12/2008 Milosavljevic
7,468,709 B2 12/2008 Niemi
7,498,990 B2 3/2009 Park et al.
7,501,983 B2 3/2009 Mikkola
7,502,598 B2 3/2009 Kronberger
7,564,413 B2 7/2009 Kim et al.
7,589,678 B2 9/2009 Nissinen et al.
7,616,158 B2 11/2009 Mark et al.
7,633,449 B2 12/2009 Oh
7,663,551 B2 2/2010 Nissinen
7,679,565 B2 3/2010 Sorvala
7,692,543 B2 4/2010 Copeland
7,710,325 B2 5/2010 Cheng
7,724,204 B2 5/2010 Annamaa
7,760,146 B2 7/2010 Ollikainen
7,764,245 B2 7/2010 Loyet
7,786,938 B2 8/2010 Sorvala
7,800,544 B2 9/2010 Thornell-Pers
7,830,327 B2 11/2010 He
7,843,397 B2 11/2010 Boyle
7,889,139 B2 2/2011 Hobson et al.
7,889,143 B2 2/2011 Milosavljevic
7,901,617 B2 3/2011 Taylor
7,903,035 B2 3/2011 MIkkola et al.
7,916,086 B2 3/2011 Koskiniemi et al.
7,963,347 B2 6/2011 Pabon
7,973,720 B2 7/2011 Sorvala
8,049,670 B2 11/2011 Jung et al.
8,054,232 B2 11/2011 Chiang et al.
8,098,202 B2 1/2012 Annamaa et al.
8,179,322 B2 5/2012 Nissinen
8,193,998 B2 6/2012 Puente et al.
8,378,892 B2 2/2013 Sorvala
8,466,756 B2 6/2013 Milosavljevic et al.
8,473,017 B2 6/2013 Milosavljevic et al.
8,564,485 B2 10/2013 Milosavljevic et al.
8,629,813 B2 1/2014 Milosavljevic
2001/0050636 A1 12/2001 Weinberger
2002/0183013 A1 12/2002 Auckland et al.
2002/0196192 A1 12/2002 Nagumo et al.
2003/0146873 A1 8/2003 Blancho
2004/0090378 A1 5/2004 Dai et al.
2004/0137950 A1 7/2004 Bolin et al.
2004/0145525 A1 7/2004 Annabi et al.
2004/0171403 A1 9/2004 Mikkola
2005/0057401 A1 3/2005 Yuanzhu
2005/0159131 A1 7/2005 Shibagaki et al.
2005/0176481 A1 8/2005 Jeong
2006/0033667 A1* 2/2006 Johnson ..... 343/702
2006/0071857 A1 4/2006 Pelzer
2006/0192723 A1 8/2006 Harada
2007/0042615 A1 2/2007 Liao
2007/0069957 A1* 3/2007 Ranta ..... 343/700 MS
2007/0082789 A1 4/2007 Nissila
2007/0152881 A1 7/2007 Chan
2007/0188388 A1 8/2007 Feng
2007/0236391 A1 10/2007 Ryou et al.
2008/0055164 A1 3/2008 Zhang et al.
2008/0059106 A1 3/2008 Wight
2008/0088511 A1 4/2008 Sorvala
2008/0266199 A1 10/2008 Milosavljevic
2009/0009415 A1 1/2009 Tanska
2009/0135066 A1 5/2009 Raappana et al.
2009/0153412 A1 6/2009 Chiang et al.
2009/0174604 A1* 7/2009 Keskitalo et al. ..... 343/700 MS
2009/0196160 A1 8/2009 Crombach
2009/0197654 A1 8/2009 Teshima
2009/0231213 A1 9/2009 Ishimiya
2010/0220016 A1 9/2010 Nissinen
2010/0244978 A1 9/2010 Milosavljevic
2010/0309092 A1 12/2010 Lambacka

(56) References Cited

U.S. PATENT DOCUMENTS

| | | | | |
|---|---|---|---|---|
| 2011/0133994 | A1 | 6/2011 | Korva | |
| 2012/0013519 | A1* | 1/2012 | Hakansson et al. | 343/835 |
| 2012/0119955 | A1 | 5/2012 | Milosavljevic et al. | |

FOREIGN PATENT DOCUMENTS

| | | | |
|---|---|---|---|
| DE | 10150149 | | 4/2003 |
| EP | 0 208 424 | | 1/1987 |
| EP | 0 376 643 | | 4/1990 |
| EP | 0 751 043 | | 4/1997 |
| EP | 0 807 988 | | 11/1997 |
| EP | 0 831 547 | | 3/1998 |
| EP | 0 851 530 | | 7/1998 |
| EP | 1 294 048 | | 1/1999 |
| EP | 1 014 487 | | 6/2000 |
| EP | 1 024 553 | | 8/2000 |
| EP | 1 067 627 | | 1/2001 |
| EP | 0 923 158 | | 9/2002 |
| EP | 1 329 980 | | 7/2003 |
| EP | 1 361 623 | | 11/2003 |
| EP | 1 406 345 | | 4/2004 |
| EP | 1432072 | A1 | 6/2004 |
| EP | 1 453 137 | | 9/2004 |
| EP | 1 220 456 | | 10/2004 |
| EP | 1 467 456 | | 10/2004 |
| EP | 1 753 079 | | 2/2007 |
| EP | 2019448 | A1 | 1/2009 |
| FI | 110395 | B | 1/2003 |
| FI | 20020829 | | 11/2003 |
| FI | 118782 | | 3/2008 |
| FR | 2553584 | | 10/1983 |
| FR | 2724274 | | 3/1996 |
| FR | 2873247 | | 1/2006 |
| GB | 2266997 | | 11/1993 |
| GB | 2360422 | | 9/2001 |
| GB | 2389246 | | 12/2003 |
| JP | 59-202831 | | 11/1984 |
| JP | 60-206304 | | 10/1985 |
| JP | 61-245704 | | 11/1986 |
| JP | 06-152463 | | 5/1994 |
| JP | 07-131234 | | 5/1995 |
| JP | 07-221536 | | 8/1995 |
| JP | 07-249923 | | 9/1995 |
| JP | 07-307612 | | 11/1995 |
| JP | 08-216571 | | 8/1996 |
| JP | 09-083242 | | 3/1997 |
| JP | 09-260934 | | 10/1997 |
| JP | 09-307344 | | 11/1997 |
| JP | 10-028013 | | 1/1998 |
| JP | 10-107671 | | 4/1998 |
| JP | 10-173423 | | 6/1998 |
| JP | 10-209733 | | 8/1998 |
| JP | 10-224142 | | 8/1998 |
| JP | 10-322124 | | 12/1998 |
| JP | 10-327011 | | 12/1998 |
| JP | 11-004113 | | 1/1999 |
| JP | 11-004117 | | 1/1999 |
| JP | 11-068456 | | 3/1999 |
| JP | 11-127010 | | 5/1999 |
| JP | 11-127014 | | 5/1999 |
| JP | 11-136025 | | 5/1999 |
| JP | 11-355033 | | 12/1999 |
| JP | 2000-278028 | | 10/2000 |
| JP | 2001-053543 | | 2/2001 |
| JP | 2001-267833 | | 9/2001 |
| JP | 2001-217631 | | 10/2001 |
| JP | 2001-326513 | | 11/2001 |
| JP | 2002-319811 | | 10/2002 |
| JP | 2002-329541 | | 11/2002 |
| JP | 2002-335117 | | 11/2002 |
| JP | 2003-060417 | | 2/2003 |
| JP | 2003-124730 | | 4/2003 |
| JP | 2003-179426 | | 6/2003 |
| JP | 2004-112028 | | 4/2004 |
| JP | 2004-363859 | | 12/2004 |
| JP | 2005-005985 | | 1/2005 |
| JP | 2005-252661 | | 9/2005 |
| KR | 20010080521 | | 10/2001 |
| KR | 20020096016 | | 12/2002 |
| SE | 511900 | | 12/1999 |
| WO | WO 92/00635 | | 1/1992 |
| WO | WO 96/27219 | | 9/1996 |
| WO | WO 98/01919 | | 1/1998 |
| WO | WO 99/30479 | | 6/1999 |
| WO | WO 01/20718 | | 3/2001 |
| WO | WO 01/29927 | | 4/2001 |
| WO | WO 01/33665 | | 5/2001 |
| WO | WO 01/61781 | | 8/2001 |
| WO | WO 2004/017462 | | 2/2004 |
| WO | WO 2004/057697 | | 7/2004 |
| WO | WO 2004/100313 | | 11/2004 |
| WO | WO 2004/112189 | | 12/2004 |
| WO | 2005038981 | A1 | 4/2005 |
| WO | WO 2005/062416 | | 7/2005 |
| WO | WO 2005/083835 | A2 | 9/2005 |
| WO | 2006070233 | A1 | 7/2006 |
| WO | 2007000483 | A1 | 1/2007 |
| WO | WO 2007/012697 | | 2/2007 |
| WO | 2008023095 | A1 | 2/2008 |
| WO | 2010122220 | A1 | 10/2010 |
| WO | WO 2010/122220 | | 10/2010 |
| WO | WO 2010/139120 | A1 | 12/2010 |

OTHER PUBLICATIONS

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

Abedin, M. F. and M. Ali, "Modifying the ground plane and its erect on planar inverted-F antennas (PIFAs) for mobile handsets," *IEEE Antennas and Wireless Propagation Letters*, vol. 2, 226-229, 2003.

C. R. Rowell and R. D. Murch, "A compact PIFA suitable for dual frequency 900/1800-MHz operation," *IEEE Trans. Antennas Propag.*, vol. 46, No. 4, pp. 596-598, Apr. 1998.

Cheng-Nan Hu, Willey Chen, and Book Tai, "A Compact Multi-Band Antenna Design for Mobile Handsets", *APMC 2005 Proceedings*.

Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.

European Office Action, May 30, 2005 issued during prosecution of EP 04 396 001.2-1248.

Examination Report dated May 3, 2006 issued by the EPO for European Patent Application No. 04 396 079.8.

F.R. Hsiao, et al. "A dual-band planar inverted-F patch antenna with a branch-line slit," *Microwave Opt. Technol. Lett.*, vol. 32, Feb. 20, 2002.

Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.

Guo, Y. X. and H. S. Tan, "New compact six-band internal antenna," *IEEE Antennas and Wireless Propagation Letters*, vol. 3, 295-297, 2004.

Guo, Y. X. and Y.W. Chia and Z. N. Chen, "Miniature built-in quadband antennas for mobile handsets", *IEEE Antennas Wireless Propag. Lett.*, vol. 2, pp. 30-32, 2004.

Hoon Park, et al. "Design of an Internal antenna with wide and multiband characteristics for a mobile handset", *IEEE Microw. & Opt. Tech. Lett.* vol. 48, No. 5, May 2006.

(56) References Cited

OTHER PUBLICATIONS

Hoon Park, et al. "Design of Planar Inverted-F Antenna With Very Wide Impedance Bandwidth", *IEEE Microw. & Wireless Comp., Lett.*, vol. 16, No. 3, pp. 113-115-, Mar. 2006.
Hossa, R., A. Byndas, and M. E. Bialkowski, "Improvement of compact terminal antenna performance by incorporating open-end slots in ground plane," *IEEE Microwave and Wireless Components Letters*, vol. 14, 283-285, 2004.
I. Ang, Y. X. Guo, and Y. W. Chia, "Compact internal quad-band antenna for mobile phones" *Micro. Opt. Technol. Lett.*, vol. 38, No. 3 pp. 217-223 Aug. 2003.
International Preliminary Report on Patentability for International Application No. PCT/FI2004/000554, date of issuance of report May 1, 2006.
Jing, X., et al.; "Compact Planar Monopole Antenna for Multi-Band Mobile Phones"; Microwave Conference Proceedings, 4.-7.12.2005. APMC 2005, Asia-Pacific Conference Proceedings, vol. 4.
Kim, B. C., J. H. Yun, and H. D. Choi, "Small wideband PIFA for mobile phones at 1800 MHz," *IEEE International Conference on Vehicular Technology*, 27{29, Daejeon, South Korea, May 2004.
Kim, Kihong et al., "Integrated Dipole Antennas on Silicon Substrates for Intra-Chip Communication", IEEE, pp. 1582-1585, 1999.
Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71{86, 2004.
K-L Wong, *Planar Antennas for Wireless Communications*, Hoboken, NJ: Willey, 2003, ch. 2.
Lindberg., P. and E. Ojefors, "A bandwidth enhancement technique for mobile handset antennas using wavetraps," *IEEE Transactions on Antennas and Propagation*, vol. 54, 2226{2232, 2006.
Marta Martinez-Vazquez, et al., "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and WLAN Standards", *Electronic Letters*, vol. 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp. Lett.*, vol. 14, No. 4, pp. 148-150, Apr. 2004.
P. Salonen, et al. "New slot configurations for dual-band planar inverted-F antenna," *Microwave Opt. Technol.*, vol. 28, pp. 293-298, 2001.
Papapolymerou, Ioannis et al., "Micromachined Patch Antennas", IEEE Transactions on Antennas and Propagation, vol. 46, No. 2, pp. 275-283, Feb. 1998.
Product of the Month, RFDesign, "GSM/GPRS Quad Band Power Amp Includes Antenna Switch," 1 page, reprinted Nov. 2004 issue of RF Design (www.rfdesign.com), Copyright 2004, Freescale Semiconductor, RFD-24-EK.
S. Tarvas, et al. "An internal dual-band mobile phone antenna," in *2000 IEEE Antennas Propagat. Soc. Int. Symp. Dig.*, pp. 266-269, Salt Lake City, UT, USA.
Wang, F., Z. Du, Q. Wang, and K. Gong, "Enhanced-bandwidth PIFA with T-shaped ground plane," *Electronics Letters*, vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. 2003, vol. 51, No. 1.
X.-D. Cai and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Joshi, Ravi K., et al., "Broadband Concentric Rings Fractal Slot Antenna", XXVIIIth General Assembly of International Union of Radio Science (URSI). (Oct. 23-29, 2005), 4 Pgs.
Singh, Rajender, "Broadband Planar Monopole Antennas," M.Tech credit seminar report, Electronic Systems group, EE Dept, IIT Bombay, Nov. 2003, pp. 1-24.
Gobien, Andrew, T. "*Investigation of Low Profile Antenna Designs for Use in Hand-Held Radios*," Ch.3, *The Inverted-L Antenna and Variations*; Aug. 1997, pp. 42-76.
See, C.H., et al., "Design of Planar Metal-Plate Monopole Antenna for Third Generation Mobile Handsets," Telecommunications Research Centre, Bradford University, 2005, pp. 27-30.
Chen, Jin-Sen, et al., "CPW-fed Ring Slot Antenna with Small Ground Plane," Department of Electronic Engineering, Cheng Shiu University.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. of Electrical Engineering, National Sun Yat-Sen University, 2002 09 Ansoft Workshop, pp. 1-45.
"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.
Extended European Search Report dated Jan. 30, 2013, issued by the EPO for EP Patent Application No. 12177740.3.

* cited by examiner

MULTI-RESONANCE ANTENNA, ANTENNA MODULE, RADIO DEVICE AND METHODS

PRIORITY AND RELATED APPLICATIONS

This application is a National Stage Application of, and claims priority to, under 35 U.S.C. 371, International Application No. PCT/FI2012/050025, filed Jan. 12, 2012, which claims the benefit of priority to Finnish Patent Application Serial No. 20115072 filed Jan. 25, 2011, the priority benefit of which is also herein claimed, each of the foregoing being incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

1. Technological Field

The disclosure relates generally to an antenna and an antenna module of a radio device, such as small-sized mobile wireless terminals, and particularly in one exemplary aspect to a multi-resonance antenna.

2. Description of Related Technology

In small data processing devices, which also have a transmitter-receiver for connecting to a wireless data transfer network, such as in mobile phone models, PDA devices (Personal Digital Assistant) or portable computers, the antenna may be placed inside the cover of the data processing device.

The data processing device must often function in a system, where two or more frequency bands can be utilised, when necessary, which bands may be relatively far from each other. The utilised frequency bands may for example be in the frequency ranges 824-960 MHz and 1 710-2 170 MHz. These frequency bands are utilised for example in various mobile phone networks. The data processing device thus needs several antennae, so data transfer on different frequency bands can be handled. Supply to the antennae can be handled via a supply point, which is shared by the antennae, or alternatively each utilised antenna has its own antenna-specific supply point.

One solution for utilising two frequency bands in the same data processing device is to use two separate antenna arrangements, for example so that each frequency band has its own antenna in the device. Possible types of antennae to be utilised are half-wave antennae (two separate antennae) and various antennae utilising two resonance frequencies and IFA antennae (Inverted-F Antenna). In such antennae it is possible to utilise different passive (parasitic) antenna elements in determining the resonance locations on the antenna. In such antenna solutions the two frequency bands used by the data processing device may be formed and tuned independently from each other within certain limits.

Data transfer taking place on one frequency band must not disturb data transfer taking place on some other frequency band in the same data processing device. Therefore an antenna solution utilising one frequency band must attenuate the signals on the frequency band of another antenna solution by at least 12 dB.

It is however a disadvantage with two separate antenna arrangements that it is difficult to realise the space needed for both antennae in the data processing device. The parasite element required by the lower frequency band antenna has a large size, so the area/space remaining for the upper frequency band antenna element is small. In this situation the antenna of only one of the frequency bands can be optimised in a desired manner. Optimising both antennae on both frequency bands simultaneously requires an increase of about 20% in the surface area of the antenna arrangement. Additionally both the antennae must be supplied from their own supply point.

In WO 2006/070233 there is disclosed an antenna solution where one monopole antenna and a parasitic radiating element are utilized. The monopole antenna radiates its natural frequency and harmonic frequencies. The parasitic element radiates in two operating bands.

In EP 1432072 there is disclosed an antenna system having two monopole antennas and a parasitic element. Either the monopole antenna(s) or the parasitic element is a rigid wire or metal plate structure and is located over the other party.

In WO 2010/122220 there is disclosed an embodiment where a monopole antenna and a parasitic radiator are implemented on the cover structure of a mobile phone. The monopole antenna has resonance frequencies both in the lower and upper operating band and the parasitic radiator has a resonance in the upper operating band.

Adapting the antennae of the data processing device to the frequency bands to be used can also be done by utilising discrete components on the circuit board of the data processing device. This solution makes possible the utilisation of a shared supply point for both antennae being used. The adapting however typically requires five discrete components to be connected to the circuit board. Optimisation of two frequency ranges implemented with so many components is a difficult task. Especially if the adaptation circuits must be connected in connection with the actual antenna elements, the inductances of the used connectors also make the adaptation work of the antennae more difficult.

The present disclosure provides, inter alia, an antenna for two frequency ranges, where both the upper and the lower frequency band have two resonance locations determined with the mechanical sizing of the antenna. The resonance locations increase the bandwidth on both frequency bands, which can be utilized by the data processing device.

One salient advantage of the disclosure is that both the lower and the upper frequency band have resonance locations generated with both the actual antenna element and the parasite element. The locations of the resonance locations are determined with a coil determining the electric length of the radiators, the radiator of the parasite element and the lower frequency range. With the antenna solution according to embodiments of the disclosure the usable bandwidth grows on both utilized frequency ranges.

It is additionally an advantage of embodiments of the disclosure that the antenna does not require discrete components to be installed on the circuit board in either frequency range.

It is further and advantage of embodiments of the disclosure that the antennae are configured with the mechanical sizing of the partial components of the antenna arrangement and with their mutual positioning. Discrete components installed on the circuit board are not needed.

It is further an advantage of embodiments of the disclosure that the parasite element within the antenna arrangement affects the used frequency bands so little that it can be used as a visual element so that it can be shaped freely, for example, as a visual element of the data processing device.

It is further an advantage of embodiments of the disclosure that the same parasite element is used both for the lower and the upper frequency range and the antenna arrangement has a compact size.

It is further an advantage of embodiments of the disclosure that due to properties of the parasite element, the hand of the user of the data processing device does not substantially weaken the adaptation of the antennae.

It is further an advantage of embodiments of the disclosure that the signals of an antenna utilizing either of the frequency ranges are attenuated in the frequency range utilized by the antenna in an antenna arrangement with one supply point, where the upper and lower band are connected together, by at least 9 dB, It is still an advantage of embodiments of the disclosure that the same parasite element solution can be used in antenna solutions with one supply point or with two separate supply points.

The antenna arrangement according to one embodiment of the disclosure comprises two antenna elements of monopole-type, which can be connected to a supply point, and one shared parasite element, which together provide two frequency bands to be utilized in the data processing device. In one variant, the antenna arrangement is implemented on the surface of a dielectric piece. The dielectric piece may for example comprise a rectangular polyhedron, whereby the antenna arrangement can be implemented on two or more surfaces of the rectangular polyhedron. The dielectric piece, on the surfaces of which the radiating elements and parasite element are manufactured, is called an antenna module. The antenna module is advantageously installed in one end of the circuit board of the data processing device, so that the ground plane of the circuit board of the data processing device does not extend to the part of the circuit board, which is left underneath the antenna module installed in its place. The active antenna elements are placed on a surface or face of the dielectric piece (antenna module), which is not disposed adjacent the circuit board. The two antenna elements of the antenna arrangement may either have a shared supply point/antenna port or both antenna elements may have their own separate supply point/antenna port on the surface of the polyhedron.

The parasite element of one embodiment of the antenna arrangement is advantageously arranged as a U-shaped conductor strip, which in the case of a dielectric polyhedron is on three sides of the polyhedron which are perpendicular to the plane of the circuit board. The ends of the U of the parasite element point toward the ground plane of the circuit board of the data processing device without reaching it. When the antenna module is installed on the circuit board, the "bottom" of the U extends close to the end of the circuit board, where the antenna module is attached.

In another embodiment, the parasite element is connected to the ground plane of the data processing device with one conductive strip, which is at the level of the circuit board and in the direction of the longitudinal axis of the circuit board. The short-circuiting conductive strip of the parasitic element is connected to the ground plane of the circuit board at a point, which is close to the supply point/points of the antenna elements on the opposite side of the antenna module. The connecting point between the conductive strip and the parasite element divides the parasite element into two parts comprised of a lower frequency band parasite element and a upper frequency band parasite element. The resonance of the lower frequency of the parasite element is adjusted with the length of the ground contact. The lower resonance of the parasite element is a quarter-wave resonance. The resonance of the higher frequency is determined by the length of the parasite element (the longest dimension). The higher resonance is thus a half-wave resonance.

The resonance locations of the antenna arrangement according to embodiments of the disclosure, and thus the available frequency ranges, are determined only by the distance between the supply point of the radiating elements and the supply point/short-circuit conductive strip of the parasite element and with the mechanical measurements of the short-circuit conductive strip.

The antenna structure according to another embodiment of the disclosure has two separate resonance locations on both frequency bands. The location of the lower resonance location is on both frequency bands determined by the parasite element and the location of the upper resonance location is determined by the mechanical sizing of the radiating antenna element. The two separate resonance locations achieved with the antenna arrangement provide a desired bandwidth in both utilized frequency ranges.

In another aspect of the disclosure, a multiband antenna for use in a radio device is disclosed. In one embodiment, the multiband antenna includes a circuit board having a ground plane disposed on a first portion of the circuit board, and a second portion on which the ground plane is not disposed. The multiband antenna also includes a dielectric component disposed on the second portion of the circuit board and a first and a second radiating element resident on an upper surface of the dielectric component. The first and the second radiating elements are configured to radiate at a lower and an upper frequency band, respectively. A parasitic element is disposed on a plurality of surfaces of the dielectric component that are perpendicular to the ground plane of the circuit board.

In an alternative embodiment, the multiband antenna includes a circuit board having a ground plane. A dielectric piece that is installed on a first end of the circuit board and the first end of the circuit board has the ground plane removed. First and second monopole-type elements resident on an upper surface of the dielectric piece radiate in separate frequency bands, the first and second monopole-type elements corresponding to lower and upper frequency bands, respectively. The multiband antenna also includes a parasitic element that is electromagnetically coupled to the first and second monopole-type elements on at least one surface of the dielectric piece.

In yet another alternative embodiment, the multiband antenna includes a dielectric piece, which has a first surface. First and second monopole-type elements radiate on a lower and an upper band, respectively, with their supply points being resident on a second surface of the dielectric piece. The second surface is substantially parallel to the first surface with a parasitic element on at least one surface of the dielectric piece. The parasitic element forms an angle in relation to the first and the second surface. The multi-band antenna is configured to provide on both the lower band and the upper band two resonance locations in order to widen the frequency range of the lower and upper bands. The resonance of the lower functional band is caused by the parasitic element and the resonance of the upper band is the natural resonance of the first and the second monopole-type elements.

In another aspect of the invention, a radio device is disclosed. In one embodiment, the radio device includes at least one internal multi-band antenna having first and second functional bands. The radio device also includes a first monopole-type element configured to radiate on a lower frequency band and a second monopole-type element configured to radiate on an upper frequency band. A parasite element is electromagnetically coupled to the first and second monopole-type elements. The first and second monopole-type elements are coupled to one or more supply points connected to an antenna port of the radio device, and the parasite element is coupled from a first short-circuit point to a ground plane of the radio device. The first monopole-type radiating element of the lower frequency band is arranged to be supplied from the supply point connected to the antenna port, and the first monopole-type radiating element together with the other parts of the multi-band antenna forms a first resonator within the lower frequency band. The second monopole-type radiating element of the upper frequency band is arranged to be supplied from the supply point connected to the antenna port and form a second resonator that resonates within an upper frequency band. The parasite element is grounded only from a connecting point to the ground plane of the circuit board, and forms together with the surrounding antenna parts a third resonator. Both the lower frequency band and the upper frequency band have two resonance locations in order to widen the functional band. The resonance associated with the lower frequency band is caused by the parasite element and the resonance associated with the higher frequency band being caused by the first and second monopole-type elements.

Figure 1B:
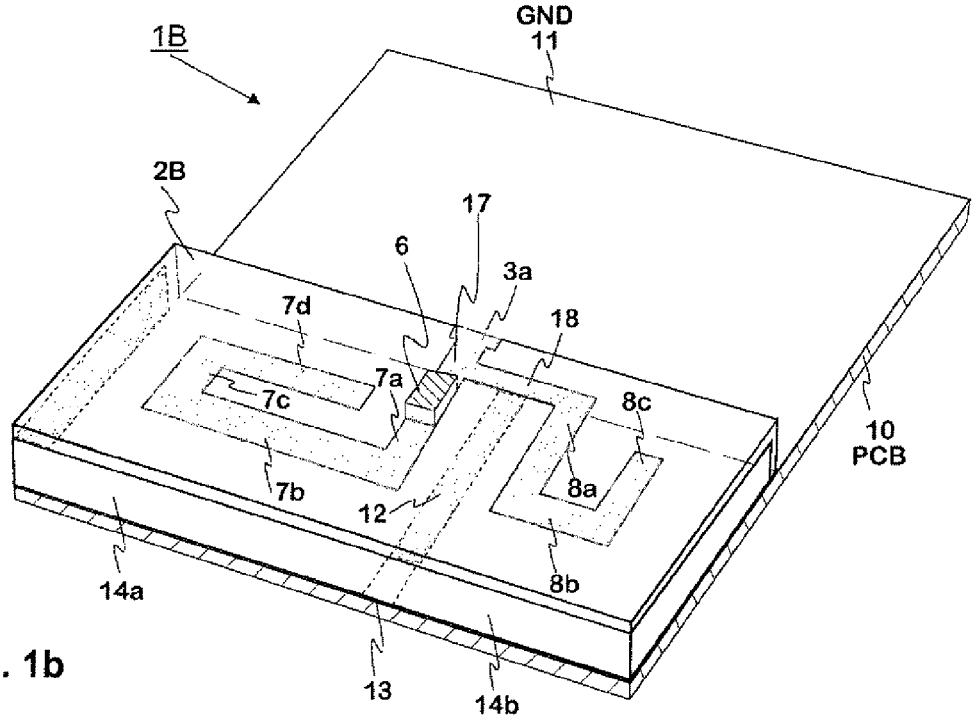
Figure 1C:
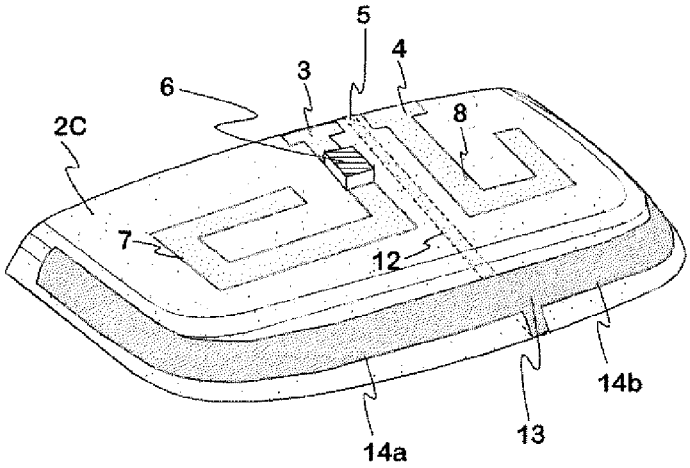
Figure 2:
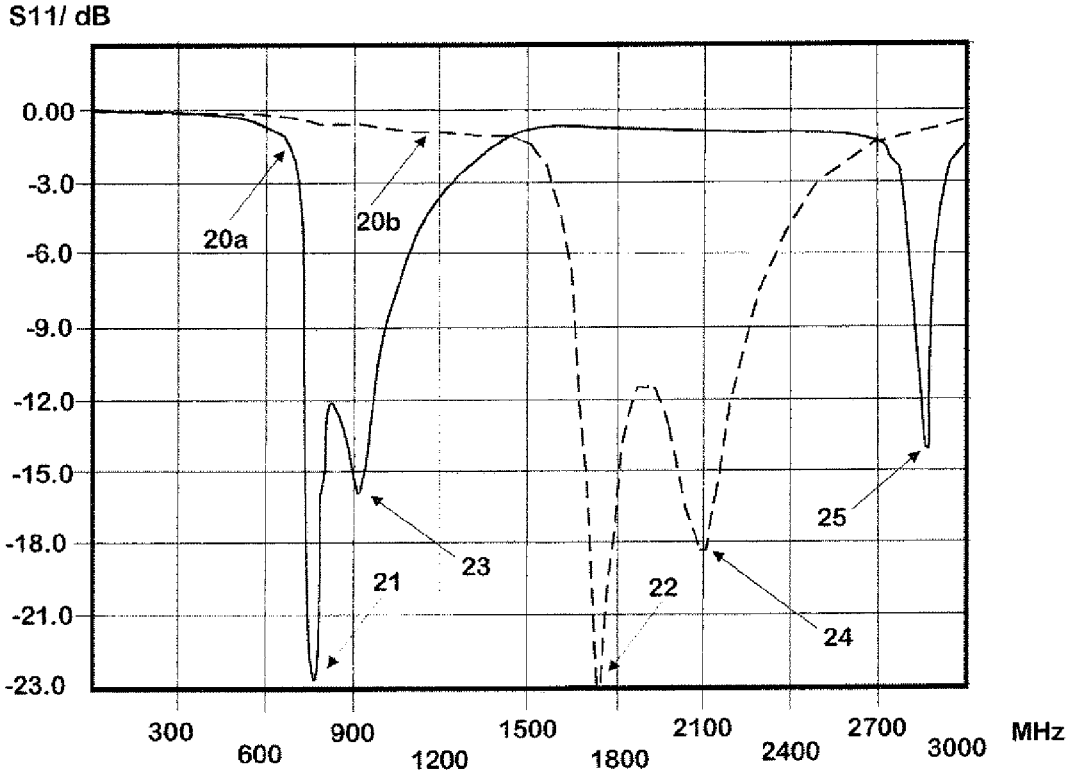
Figure 3:
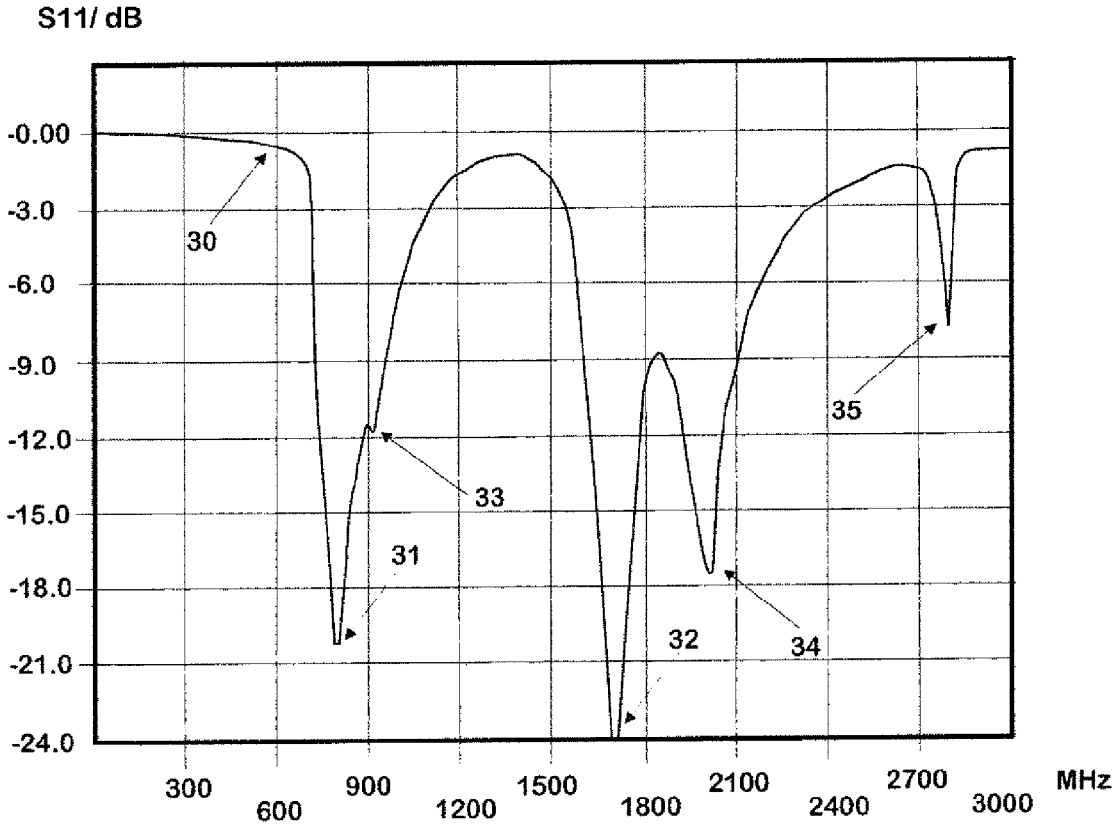
Figure 4:
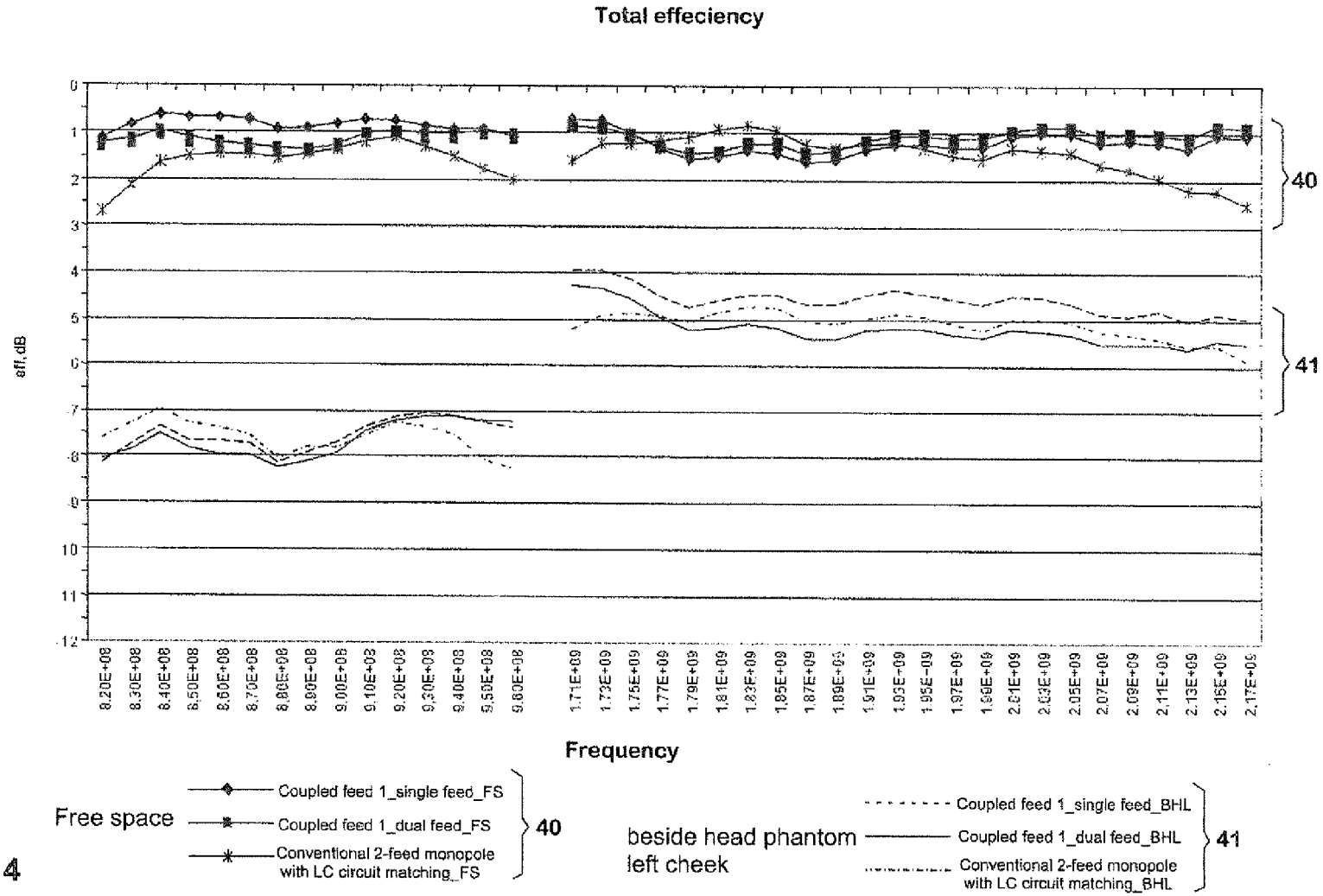
Figure 5A:
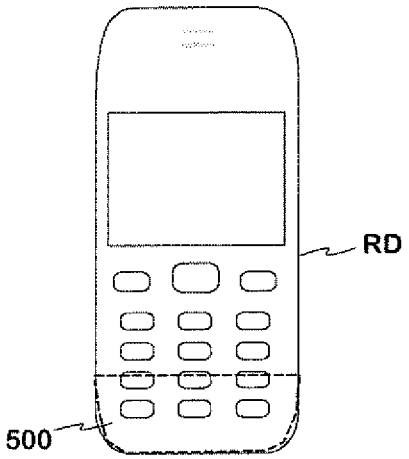
Figure 5B:
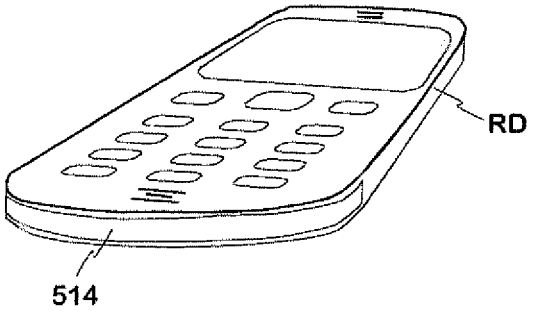
Figure 6A:
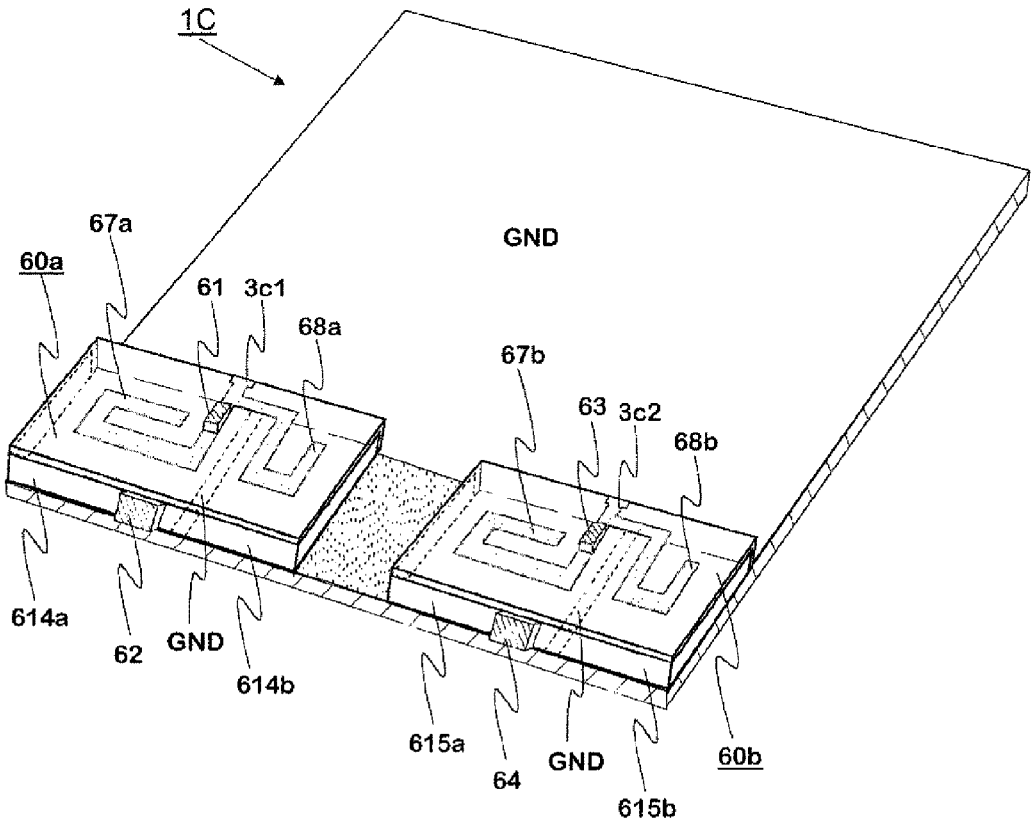
Figure 6B:
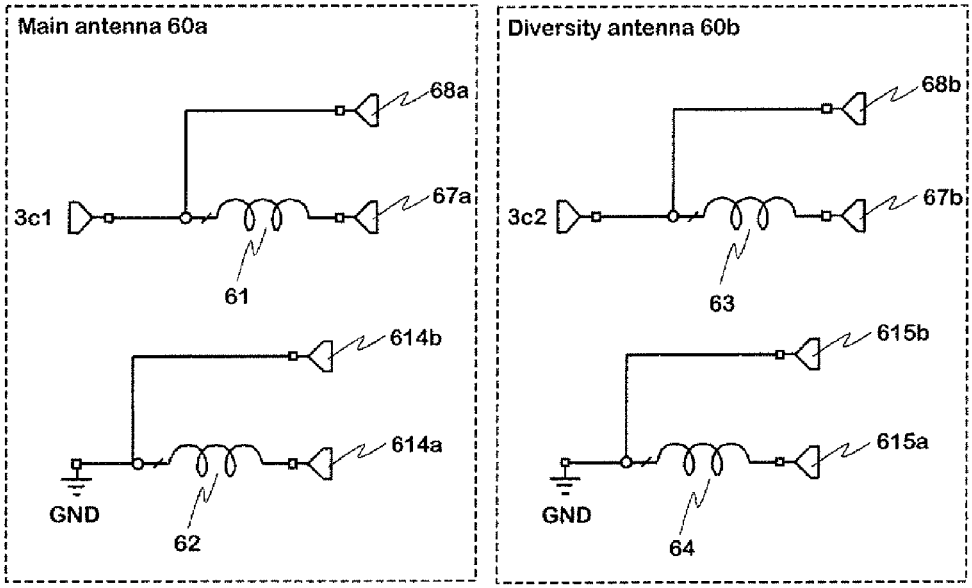
Figure 6C:
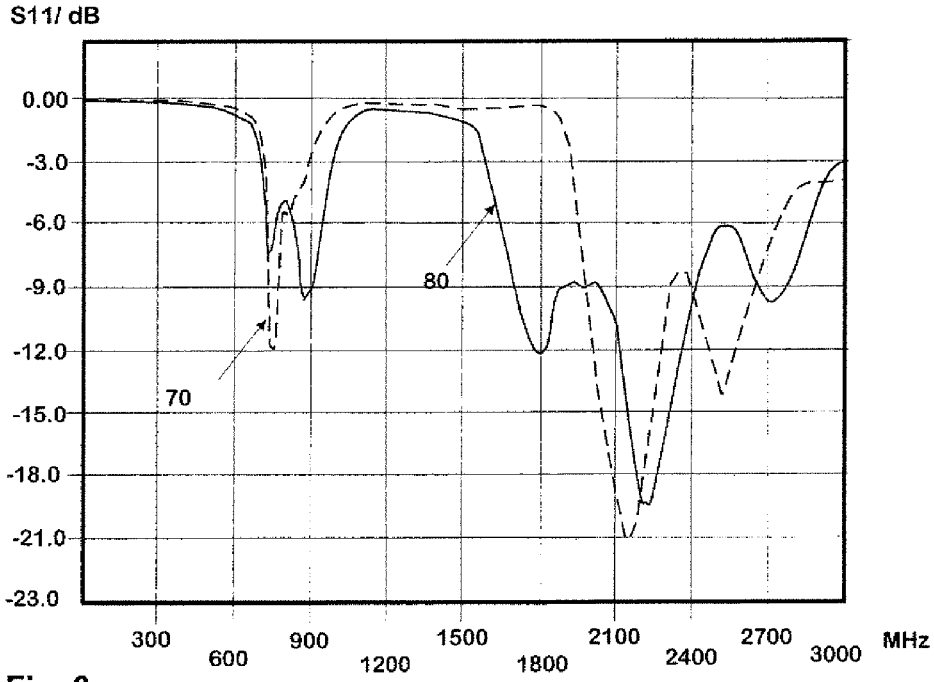

These and other features, objectives, and advantages of the disclosure will become more apparent from the detailed description set forth below when taken in conjunction with the drawings, wherein:

FIG. 1*a* shows as an example an antenna arrangement with two supply points according to the invention on a dielectric polyhedron, FIG. 1*b* shows as an example an antenna arrangement with one supply point according to the invention on a dielectric polyhedron, FIG. 1*c* shows as an example an antenna arrangement with two supply points according to the invention on an irregular dielectric piece, FIG. 2 shows reflection attenuations of antennae measured from an antenna arrangement with two supply points, FIG. 3 shows reflection attenuation measured from an antenna arrangement with one supply point, FIG. 4 shows the efficiency of an antenna arrangement according to the invention as measured in a free state and using an artificial head arrangement, FIG. 5*a* shows an example of a radio device according to the invention, FIG. 5*b* shows an example of a radio device, on the outer cover of which a parasite element forms a visible part FIG. 6*a* shows as an example of an antenna arrangement where two antenna arrangements according to the invention form a diversity antenna system, FIG. 6*b* shows the connecting diagram of the antenna arrangement of FIG. 6*a*, and FIG. 6*c* shows reflection attenuations of the main antenna and the diversity antenna of FIG. 6*b*.

The embodiments in the following description are given as examples only, and someone skilled in the art may carry out the basic idea of the invention also in some other way than what is described in the description. Though the description may refer to a certain embodiment or embodiments in different places, this does not mean that the reference would be directed towards only one described embodiment or that the described characteristic would be usable only in one described embodiment. The individual characteristics of two or more embodiments may be combined and new embodiments of the invention may thus be provided.

FIGS. 1*a* and 1*b* show an antenna arrangement according to the invention, where a dielectric polyhedron is utilised. In the example in FIG. 1*c* the dielectric piece has one planar surface and the rest of the dielectric piece is made up of at least partly curved surfaces, which advantageously conform to the shapes of the cover of the data processing device.

FIG. 1*a* shows an example of an antenna arrangement 1A according to the invention, where the two monopole-type radiating elements 7 and 8 have their own supply point/antenna port, reference numbers 3 and 4, on the upper surface (radiating plane) of the antenna module 2A (polyhedron). The antenna arrangement 1A in FIG. 1*a* can advantageously be used as the antenna of a data processing device, which utilises two separate frequency bands. The used frequency bands may for example be 824-960 MHz and 1 710-2 170 MHz.

The data processing device comprises a planar circuit board 10 (PCB). The main part of the conductive upper surface 11 of the circuit board 10 can function as the ground plane (GND) of the data processing device. The circuit board 10 advantageously has a rectangular shape, which has a first end 10*a* and a second end 10*b*, which are parallel. The ground plane 11 extends from the second end 10*b* of the circuit board 10 to the grounding point 5 of the parasite element 14 of the antenna module comprised in the antenna arrangement 1A according to the invention. In the antenna arrangement 1A according to the invention the antenna module 2A to be used is installed in the first end 10*a* of the circuit board 10. The ground plane 11 has been removed from the first end 10*a* of the circuit board 10 at the part left underneath the antenna module 2A.

The antenna module 2A of the antenna arrangement 1A according to the invention is advantageously implemented on a dielectric polyhedron, all the faces of which are advantageously rectangles. Thus the opposite faces of the polyhedron are of the same shape and size. The outer dimensions of the polyhedron are advantageously the following. The long sides 2*a* and 2*d* of the polyhedron projected onto the level of the circuit board 10, which in FIG. 1*a* are in the direction of the first end 10*a* of the circuit board, advantageously have a length of about 50 mm. The short sides 2*b* and 2*c* of the polyhedron projected onto the level of the circuit board 10 are in the direction of the sides in the direction of the longitudinal axis of the circuit board 10. The short sides 2*b* and 2*c* of the polyhedron advantageously have a length of about 15 mm. The thickness of the polyhedron is advantageously about 5 mm.

The antenna module 2A is advantageously installed in the first end 10*a* of the circuit board 10. The ground plane 11 of the circuit board 10 is removed from the surface area of the first end 10*a* of the circuit board 10, which is left underneath the antenna module 2A when installed into place. Electronic components of the data processing device (not shown in FIG. 1*a*) are installed in the second end 10*b* of the circuit board 10.

In the example in FIG. 1*a* the exemplary parasite element 14 comprised in the antenna arrangement 1A according to the invention is implemented on three sides/surfaces 2*a*, 2*b* and 2*c* of the antenna module 2A, which are perpendicular to the level defined by the circuit board 10. The parasite element 14 is thus advantageously implemented on three surfaces of the antenna module 2A. The parasite element 14 advantageously has the shape of a flat-bottomed/sharp-angled U. The parasite element 14 is divided into two branches 14*a* and 14*b*. The branch 14*a* functions as the parasite element of the lower frequency range radiator 7. The branch 14*b* functions as the parasite element of the upper frequency range radiator 8.

The branches 14*a* and 14*b* of the parasite element 14 are connected together at the connection point 13 on the side 2*a* of the antenna module 2A. The connection point 3 of the branches 14*a* and 14*b* of the parasite element 14 is in the example of FIG. 1*a* closer to the shorter side 2*c* of the antenna module than to the side 2*b*. In the example of FIG. 1*a* the branches 14*a* and 14*b* of the parasite element 14 are conductive strips.

When the antenna module 2A is installed into place the branches 14*a* and 14*b* of the parasite element 14 are close to the outer edges of the first end 10*a* of the circuit board 10. Thus the bottom of the U of the parasite element 14 is substantially in the direction of the side (edge) 2*a* of the antenna module 2A and the end 10*a* of the circuit board 10. The first arm 14*a*1 of the U of the parasite element 14 is in the direction of the side 2*b* of the antenna module 2A. The second arm 14*b*1 of the U of the parasite element 14 is in the direction of the side 2*c* of the antenna module 2A. Thus the arms 14*a*1 and 14*b*1 of the parasite element 14 are directed toward the side 2*d* of the antenna module 2A and simultaneously toward the ground plane 11 of the circuit board 10. The arms 14*a*1 and 14*b*1 do however not extend so far that they would generate an electric contact to the ground plane 11 of the circuit board 10.

The conductive strip 12 of the parasite element 14, which short-circuits to the ground plane 11 of the circuit board 10, is connected to the ground plane 11 of the circuit board 10 at the grounding/connecting point 5. A conductive strip 12 in the direction of the longitudinal axis of the circuit board departs from the grounding point 5 toward the side 2*a* of the antenna module 2A, which conductive strip 12 is joined with the U-shaped parasite element 14 at the connecting point 13 of its branched 14*a* and 14*b*. The grounding point 5 of the conductive strip 12 and the ground plane 11 is situated at the ground plane 11 of the circuit board 10 close to the points, where the supply points 3 and 4 of the antenna element situated on the upper surface of the antenna module 2A can be projected onto the level of the circuit board. The distance between the connecting point 5 and the projections of the supply points 3 and/or 4 in the level defined by the circuit board 10 is advantageously in the range of 1-4 mm. This projected distance/distances and the length and width of the conductive strip 12 of the parasite element 14 short-circuiting to the ground plane 11 are used to determine the resonance frequency of the lower frequency band provided with the parasite element 14. The resonance location caused by the parasite element on the lower frequency band is a so-called quarter-wave resonance. This resonance location is hereafter called the first resonance of the lower frequency band.

The parasitic resonance location of the upper frequency band is determined by the total length of the parasite element 14. The resonance frequency on the upper frequency band is a so-called half-wave resonance location. This resonance location is hereafter called the first resonance of the upper frequency band.

The monopole-type radiators 7 and 8 of the antenna arrangement 1A are on the planar upper surface (radiating surface) of the antenna module 2A. The monopole-type radiators 7 and 8 are formed from conductive strips, the lengths of which are in the range of a quarter-wave in either of the frequency ranges used by the data processing device. The width of the conductive strips forming the radiators 7 and 8 is advantageously in the range of 0.5-3 mm.

The lower frequency range radiator 7 is supplied from the antenna port/supply point 3. The supply point 3 and the radiating element 7 are connected by a coil 6, the inductance of which is approximately 13 nH. The coil 6 is used to shorten the physical length of the lower frequency range radiator 7, whereby the surface area required by the radiator 7 is reduced. The lower frequency band radiator 7 advantageously comprises four conductive parts 7*a*, 7*b*, 7*c* and 7*d*, which make up the first conductor branch. The first conductive part 7*a* is in the direction of the longitudinal axis of the circuit board 10, and its starting point is the coil 6 and its direction is toward the longer side 2*a* of the antenna module 2A. Before the longer side 2*a* of the antenna module 2A it turns by 90° and is connected to the second conductive part 7*b*, which is in the direction of the side 2*a* of the antenna module 2A. The direction of the second conductive part is toward the side 2*b* of the antenna module 2A. The second conductive part 7*b* is connected to the third conductive part 7*c* before the side 2*b* of the antenna module 2A. At the connecting point a 90° turn occurs in the same direction as in the previous connecting point. The third conductive part 7*c* is in the direction of the side 2*b* of the antenna module 2A and it travels from the connecting point toward the side 2*d* of the antenna module 2A. The third conductive part 7*c* is connected to the fourth conductive part 7*d* before the side 2*d* of the antenna module 2A. At the connecting point a 90° turn occurs in the same direction as in the previous connecting points. From this connecting point the fourth conductive part 7*d* continues in the direction of the side 2*d* of the antenna module 2A toward the first conductive part 7*a*, however without reaching it. The total length of the radiator 7 and the coil 6 affecting the electric length of the radiator 7 generate a λ/4 resonance at the lower frequency range. This natural resonance location is hereafter called the upper resonance location of the lower frequency band.

The monopole-type radiator 8 of the upper frequency range is supplied from the supply point 4. The upper frequency band radiator 8 advantageously comprises three conductive parts 8*a*, 8*b* and 8*c*. The first conductive part 8*a* is in the direction of the longitudinal axis of the circuit board 10, and its starting point is the supply point 4 and its direction is toward the longer side 2*a* of the antenna module 2A. Before the side 2*a* of the antenna module 2A it is connected to the second conductive part 8*b*. In the connecting point a 90° turn occurs toward the side 2*c* of the antenna module 2A. Thus the second conductive part 8*b* is in the direction of the side 2*a* of the antenna module 2A. The second conductive part 8*b* is connected to the third conductive part 8*c* before the side 2*c* of the antenna module 2A. At the connecting point a 90° turn occurs in the same direction as in the previous connecting points. The third conductive part 8*c* is in the direction of the side 2*c* of the antenna module 2A and it continues from the connecting point toward the side 2*d* of the antenna module 2A, however without reaching it. The total length of the radiator 8 generates a λ/4 resonance on the upper frequency range used by the data processing device. This natural resonance location is hereafter called the upper resonance location of the upper frequency band.

The tuning of the antenna arrangement 1A according to FIG. 1*a* to two frequency bands is implemented as follows. The resonance location provided by the parasite element 14 on the lower frequency band is defined by the mechanical dimensions of the conductive strip 12 and by the projected distances of the connecting point 5 and the supply points 3 and 4 of the antenna radiators 7 and 8 on the level of the circuit board 10. In the antenna arrangement 1A according to the invention the location of the connecting point 5 in relation to the location of the supply points 3 and/or 4 on the level defined by the circuit board 10 and the length and width (i.e. inductance) of the conductive strip 12 of the parasite element 14 short-circuiting to the ground plane define the first resonance location generated by the parasite element 14 on the lower frequency range. The resonance is a so-called quarter-wave resonance location. The location of the first resonance location of the upper frequency range is defined by the total length of the parasite element 14, and it is a so-called half-wave resonance location.

The second resonance location (λ/4 resonance) of the antenna arrangement 1A is generated on the lower frequency band at a frequency defined by the length of the monopole-type radiator 7 and the coil 6. The second resonance location (λ/4 resonance) of the upper frequency band is defined by the length of the monopole-type radiator 8.

FIG. 1*b* shows an example of an antenna arrangement 1B according to a second embodiment of the invention, where the monopole-type radiating elements 7 and 8 have a shared supply point/antenna port 3*a* on the upper surface of the antenna module 2B.

In this embodiment the circuit board 10, the antenna module 2B installed on the circuit board and the parasite element 14 otherwise correspond to the corresponding structures in the embodiment of FIG. 1*a*. Also the location of the lower frequency range radiator 7 and its mechanical dimensions correspond to the embodiment presented in FIG. 1*a*.

In the embodiment of FIG. 1*b* there is only one supply point/antenna port 3*a*. The mechanical elements of the lower frequency range monopole-type radiator 7 are connected to the supply point 3*a* through the coil 6. The upper frequency range monopole-type radiator 8 is connected to the supply point 3*a* by means of a connection conductor 18, which is connected to the supply point at the point 17.

The tuning of the antenna arrangement 1B according to FIG. 1*b* to two frequency bands is implemented as follows. The first resonance location provided by the parasite element 14 on the lower frequency band is defined by the mechanical dimensions of the conductive strip 12 and by the distance between the connecting point 5 and the point projected by the supply point 3*a* of the antenna radiators 7 and 8 on the level of the circuit board 10. In the antenna arrangement 1B according to the invention the location of the connecting point 5 in relation to the projected location of the supply point 3*a* on the level defined by the circuit board 10 and the length and width (i.e. inductance) of the conductive strip 12 of the parasite element 14 short-circuiting to the ground plane define the first resonance location generated by the parasite element 14 on the lower frequency range. The resonance is a so-called quarter-wave resonance location. The location of the first resonance location of the upper frequency range is defined by the total length of the parasite element 14, and it is a so-called half-wave resonance location.

In the examples of FIGS. 1*a* and 1*b* the parasite element 14 is so long compared to the width of the radio device that it extends onto three sides 2*a*, 2*b* and 2*c* of the antenna module 2A or 2B. Still, if the outer dimensions of the radio device change so that the width of the radio device increases, then the parasite element 14 can be either on the end side 2*a* and the side 2*c* or only on the end side 2*a*. In all situations, the resonance frequencies of the parasite element 14 are determined in the above-described manner.

The second resonance location (λ/4 resonance) of the antenna arrangement 1B is generated on the lower frequency band at a frequency defined by the length of the monopole-type radiator 7 and the coil 6. The second resonance location (λ/4 resonance) of the upper frequency band is defined by the mechanical dimensions of the monopole-type radiator 8.

The technical advantage of the embodiments shown in FIGS. 1*a* and 1*b* is that both the lower and the upper frequency range can be sized with mechanical sizing and positioning of the antenna elements according to the invention. Thus no adaptation connecting implemented with discrete components is needed on the circuit board 10.

It is also a technical advantage of the embodiments of FIGS. 1*a* and 1*b* that antenna arrangements utilising a shared supply point or two antenna-specific supply points are structurally identical except for the supply point. Both supply methods provide desired properties both on the lower and the upper frequency band.

FIG. 1*c* shows an example of an antenna arrangement according to the invention, which is implemented on the surface of a partly irregular dielectric piece. FIG. 1*c* does not show the circuit board, onto which the antenna module 2C is installed. The two monopole-type radiating elements 7 and 8 shown in FIG. 1*c* have their own supply points/antenna ports, references 3 and 4, on the upper surface of the antenna module 2C. The branches 14*a* and 14*b* of the parasite element 14 are implemented on the at least partly curved side surfaces of the dielectric piece. The short-circuit conductor 12 of the parasite element 14 departs from the short-circuit point 5 and advances in the direction of the longitudinal axis of the circuit board functioning as an installation base on the substantially planar lower surface of the antenna module 2C toward the first end of the circuit board. At the outer edge of the antenna module 2C the short-circuit conductor 5 turns to the end surface of the antenna module 2C, where it is connected to the parasite element at the connection point 13 of the branches of the parasite element.

An antenna module with one supply point according to FIG. 1*b* can also be implemented in the same manner.

FIG. 2 shows an example of a reflection attenuation measurement of the antenna component 1A according to the first embodiment of the invention. In this embodiment both radiators have their own separate supply point 3 and 4. FIG. 2 shows with a continuous line 20*a* the reflection coefficient S11 measured from the supply point/antenna port 3 of the lower frequency band radiator 7 as decibels as a function of the frequency in the range 0-3 000 MHz. The same figure shows with a dotted line 20*b* the reflection coefficient S11 measured from the supply point 4 of the upper frequency band radiator 8 as decibels as a function of the frequency in the range 0-3 000.

The continuous line 20*a* depicts the reflection attenuation measured from the supply point 3 of the lower frequency range radiator 7. Reference 21 shows a visible first resonance location provided by the branch 14*a* of the parasite element 14 in the reflection attenuation curve. Reference 23 shows a second resonance provided by the radiator 7 and coil 6 in the lower frequency band. The reflection attenuation measured from the supply point 3 of the lower frequency range radiator 7 is at least −12 dB in the frequency range 824-960 MHz. The reflection attenuation both in the lower limit frequency 824 MHz and in the upper limit frequency 960 MHz is −14 dB.

In the upper frequency range radiator's 8 frequency range 1 710-2 170 MHz the lower frequency range antenna signal is attenuated by at least 13 dB. The first and second resonance location obtained with the antenna arrangement according to the invention provide a sufficient bandwidth in the lower utilised frequency band 824-960 MHz and a sufficient attenuation in the upper utilised frequency band 1 710-2 170 MHz.

The dotted line 20*b* depicts the reflection attenuation measured from the supply point 4 of the upper frequency range radiator 8. Reference 22 shows a first resonance location provided by the branch 14*b* of the parasite element 14 in the upper frequency band. Reference 24 shows the second resonance location provided by the radiator 8 in the upper frequency band. Reference 25 shows a multiple of the resonance of the parasite element 14*a* of the lower frequency range, which multiple is not in the utilised frequency range.

The reflection attenuation measured from the supply point 4 of the upper frequency range radiator 8 is at least −11 dB in the frequency range 1 710-2 170 MHz. The reflection attenuation both in the lower limit frequency 1 710 MHz and in the upper limit frequency 2 170 MHz is −14 dB. In the lower frequency range radiator's 7 frequency range 824-960 MHz the upper frequency range signal is attenuated by at least 13 dB. The first and second resonance location obtained with the antenna arrangement according to the invention provide a sufficient bandwidth also in the upper utilised frequency band 1 710-2 170 MHz and a sufficient attenuation in the lower utilised frequency band 824-960 MHz.

FIG. 3 shows an example of a reflection attenuation measurement of the antenna component 1B according to the second embodiment of the invention. In this embodiment both monopole-type radiators 7 and 8 have a shared supply point/antenna port 3*a*. FIG. 3 shows with a continuous line 30 the reflection coefficient S11 measured from the supply point 3*a* as decibels as a function of the frequency in the range 0-3 000 MHz.

Reference 31 shows a visible first resonance location provided by the branch 14*a* of the parasite element 14 in the reflection attenuation curve in the lower utilised frequency range. Reference 33 shows a second resonance provided by the radiator 7 and coil 6 in the lower frequency range. The reflection attenuation measured from the supply point 3*a* of the lower frequency range radiator 7 is at least −10.5 dB in the frequency range 824-960 MHz. The reflection attenuation at the lower limit frequency 824 MHz is −16 dB and at the upper limit frequency 960 MHz it is −10.5 dB.

Reference 32 shows a first resonance location provided by the branch 14*b* of the parasite element 14 in the upper utilised frequency range. Reference 34 shows the second resonance location provided by the radiator 8 in the upper frequency range. Reference 35 shows a multiple of the resonance of the parasite element 14*a* of the lower frequency range, which multiple is not in the utilised frequency range.

The reflection attenuation measured from the supply point 3*a* is in the upper frequency range 1 710-2 170 at least −9 dB. The reflection attenuation at the lower limit frequency 1 710 MHz is −18 dB and at the upper limit frequency 2 170 MHz it is −12 dB.

FIG. 4 shows the measured total efficiency of the antenna arrangements 1A and 1B according to FIGS. 1*a* and 1*b*. Additionally FIG. 4 shows comparative measurements of measurement results of a circuit solution implemented with discrete components. The results of reference 40 of FIG. 4 depict the total efficiency measured in a free state both in the lower and upper frequency range. The results on reference 41 of FIG. 4 depict the total efficiency when an artificial head arrangement is used in the measuring.

From the curves of reference 40 it can be seen that both antenna arrangements 1A and 1B according to the invention have a better efficiency than a comparative arrangement in the lower and upper edge of both utilised frequency ranges when measured in a free state. In the middle parts of the lower and upper frequency range the antenna arrangements 1A and 1B according to the invention correspond with regards to their performance to the performance of an adaptation circuit connected from discrete components.

From the curves of reference 41 it can be seen that both antenna arrangements 1A and 1B according to the invention have quite the same efficiency as a comparative arrangement in the lower and upper edge of both frequency ranges, when the measurements are performed using artificial head measuring.

FIG. 5*a* shows an example of a data processing device according to the invention, which is a radio device RD. In the radio device RD has in the figure with a dotted line been shown the internal antenna module 500 as described above, which is installed on the circuit board of the radio device. The radio device RD is advantageously a mobile phone functioning on two or more frequencies.

FIG. 5*b* shows a second example of a radio device RD according to the invention. When the antenna module 500 of the radio device is installed in place, the parasite element 514 of the antenna module according to the invention is a part of the outer cover of the radio device. It can be utilised for example when designing the appearance of the device. In the example in FIG. 5*b* the antenna module 500 according to the invention is installed in the first end of the radio device RD, where the microphone of the radio device is located. Thus the bottom of the parasite element 14 is a part of the first end of the radio device. The branches of the U of the parasite element are on the two sides in the direction of the longitudinal axis of the radio device. Thus the branches of the U of the parasite element point from the first end of the radio device, which end includes a microphone, toward the second end of the radio device.

In the examples in FIGS. 5*a* and 5*b* the antenna module 500 according to the invention is installed in the end of the radio device, where the microphone of the device is located. This type of antenna should be placed in the microphone end of the device, because there is no ground plane or other metal surface decreasing connection to the user's head underneath the radiator.

FIG. 6*a* shows an example of a diversity antenna arrangement 1C according to a third embodiment of the invention. The diversity antenna comprises two antenna modules, a main antenna module 60*a* and a diversity antenna module 60*b*, that are mounted parallel at the same end of a PCB board. The antenna modules installed on the circuit board and the parasite elements otherwise correspond to the corresponding radiator structures in the embodiment of FIG. 1*b*. Also the location of the parasitic radiator on both the main antenna module and the diversity antenna module corresponds to the location of the embodiment depicted in FIG. 1*b*.

The main antenna module 60*a* comprises two monopole-type radiating elements 67*a* and 68*a* that have a shared supply point/antenna port 3*c*1 on the upper surface of the antenna module 60*a*, The electrical length of the radiating element 67*a* has been lengthened by a coil 61. The parasitic radiator comprises also two branches 614*a* and 614*b*. The electrical length of the branch 614*a* that is near the radiating element 67*a* has been lengthened by a coil 62.

Also the diversity antenna module 60*b* comprises monopole-type radiating elements 67*b* and 68*b* that have a shared supply point/antenna port 3*c*2 on the upper surface of the antenna module 60*b*. The electrical length of the radiating element 67*b* has been lengthened by a coil 63. The parasitic radiator comprises also two branches 615*a* and 615*b*. The electrical length of the branch 615*a* that is near the radiating element 67*b* has been lengthen by a coil 64.

FIG. 6*b* shows as a circuit diagram one exemplary embodiment of a diversity antenna arrangement 1C according to a third embodiment of the invention.

The input 3*c*1 of the main antenna component 60*a* is connected to both monopole-type radiators 67*a* and 68*a*. The electrical length of the monopole-type radiator 67*a* has been lengthened by coil 61 that has an inductance of 18 nH. The parasitic radiator input GND is connected to both branches 614*a* and 614*b* of the parasitic radiator. The electrical length of the branch 614*a* has been lengthened by coil 62 that has an inductance of 22 nH.

The input 3*c*2 of the diversity antenna component 60*b* is connected to both monopole-type radiators 67*b* and 68*b*. The electrical length of the monopole-type radiator 67*b* has been lengthened by coil 63 that has an inductance of 27 nH. The parasitic radiator input GND is connected to both branches 615*a* and 615*b* of the parasitic radiator. The electrical length of the branch 615*a* has been lengthened by coil 64 that has an inductance of 33 nH.

FIG. 6*c* shows an example of a reflection attenuation measurement of the antenna component 1C according to the third embodiment of the invention. In this embodiment the main antenna component 60*a* and diversity antenna component 60*b* are mounted parallel at the same end of the PCB board. FIG. 6*c* shows with a continuous line 80 the reflection coefficient S11 measured from the supply point 3*c*1 of the main antenna component in decibels as a function of the frequency in the range of 0-3 000 MHz. With a dotted line 70 is depicted the reflection coefficient S11 measured from the supply point 3*c*2 of the diversity antenna component in decibels as a function of the frequency in the range of 0-3 000 MHz.

It can be seen in FIG. 6*c* that the diversity antenna system fulfils −6 dB return loss requirement in frequency ranges 869-960 MHz and 1 850-2 690 MHz.

Some advantageous embodiments of the antenna component according to the invention have been described above. The invention is not limited to the solutions described above, but the inventive idea can be applied in numerous ways within the scope of the claims.

The invention claimed is:

1. A multiband antenna for use in a radio device, comprising:

a circuit board comprising a ground plane disposed on a first portion of the circuit board, the circuit board further comprising a second portion on which the ground plane is not disposed;

a dielectric component disposed on the second portion of the circuit board;

a first and a second radiating element resident on an upper surface of the dielectric component, the first and the second radiating elements configured to radiate at a lower and an upper frequency band, respectively; and a parasitic element disposed on a plurality of surfaces of the dielectric component that are perpendicular to the ground plane of the circuit board.

2. The multiband antenna of claim 1, wherein the first radiating element of the lower frequency band is configured to be supplied from a first supply point coupled to an antenna port of the radio device; and wherein the second radiating element of the upper frequency band is configured to be supplied from a second supply point coupled to the antenna port.

3. The multiband antenna of claim 2, wherein the parasitic element is configured to widen each of the lower and upper frequency bands associated with the first and second radiating elements, respectively.

4. The multi-band antenna of claim 3, wherein the parasitic element is divided at a connection point of a short-circuit conductor into a first branch and a second branch.

5. The multi-band antenna of claim 4, wherein the first and second branches of the parasitic element are disposed on a third and a fourth side of the multi-band antenna.

6. The multi-band antenna of claim 5, wherein a first resonance frequency of the lower frequency band is defined by a length of a short-circuit conductor, and a second resonance frequency of the upper frequency band is defined by a total length of the parasitic element.

7. The multi-band antenna of claim 6, wherein the first resonance frequency of the lower frequency band comprises a quarter-wave resonance, and the second resonance frequency of the upper frequency band comprises a half-wave resonance.

8. A multiband antenna for use in a radio device, comprising:

a circuit board comprising a ground plane;

a dielectric piece that is installed on a first end of the circuit board, the first end of the circuit board having the ground plane removed;

first and second monopole-type elements resident on an upper surface of the dielectric piece, the first and second monopole-type elements being configured to radiate in separate frequency bands, the first and second monopole-type elements corresponding to lower and upper frequency bands, respectively; and a parasitic element that is electromagnetically coupled to the first and second monopole-type elements, the parasitic element being disposed on at least one surface of the dielectric piece;

wherein the electromagnetic coupling between the first and second monopole-type elements and the parasitic element is formed at least in part by a predominantly inductive connection of a conductive strip departing from a connecting point of the parasitic element and the first and second monopole-type elements; and wherein a magnitude of the predominantly inductive connection is determined at least in part by a distance between first and second supply points and the connecting point of the parasitic element.

9. The antenna of claim 8, wherein:

the first monopole-type element of the lower frequency band is arranged to be supplied from the first supply point connected from an antenna port, the first monopole-type element together with other portions of the multiband antenna comprising a first resonator, a natural frequency of the first resonator being in the lower frequency band;

the second monopole-type element of the upper frequency band is arranged to be supplied from the second supply point connected from the antenna port, the second monopole-type element together with the other portions of the multiband antenna comprising a second resonator, a natural frequency of the second resonator being in the upper frequency band.

10. The antenna of claim 9, wherein:

the parasitic element is grounded from the connecting point to the ground plane of the circuit board, the parasitic element in combination with the other portions of the multiband antenna comprising a third resonator; and both the lower frequency band and the upper frequency band have two resonance locations in order to widen their respective frequency bands, the resonance location associated with the lower frequency band being caused by the parasitic element and the resonance location associated with the upper frequency band being caused by the first and second monopole-type elements.

11. A multi-band antenna configured for use in a radio device, comprising:

a dielectric piece, which comprises a first surface;

a first and a second monopole-type elements that radiate on a lower and an upper band, respectively, with supply points of the first and the second monopole-type elements being resident on a second surface of the dielectric piece, the second surface being substantially parallel to the first surface; and a parasitic element on at least one surface of the dielectric piece, the parasitic element forming an angle in relation to the first and the second surface;

wherein the multi-band antenna is configured to provide on both the lower band and the upper band two resonance locations in order to widen the frequency range of the lower and upper bands;

wherein a resonance of the lower band is caused by the parasitic element and a resonance of the upper band comprises a natural resonance of the first and the second monopole-type elements; and wherein the parasitic element comprises a U-shape, a bottom part of the U-shape being situated at an end side of the multi-band antenna, and one or more adjacent sides of the U-shape being situated in a direction of a longitudinal axis of the radio device.

12. The multi-band antenna of claim 11, wherein the first monopole-type element of the lower band comprises a first supply point on a first side of the multi-band antenna, a coil, and a first quarter-wave radiator comprising four conductor branches connected to the coil.

13. The multi-band antenna of claim 12, wherein the coil is configured to at least shorten a physical length of the first monopole-type element.

14. The multi-band antenna of claim 12, wherein the dielectric piece comprises a rectangular polyhedron.

15. The multi-band antenna of claim 14, wherein the second monopole-type element of the upper band comprises a second supply point on the first side of the multi-band antenna and a second quarter-wave radiator comprising three subsequent conductor branches in electrical communication with the supply point.

16. The multi-band antenna of claim 12, wherein the second monopole-type element of the upper band comprises a second supply point on the first side of the multi-band antenna and a second quarter-wave radiator comprising three subsequent conductor branches in communication with the supply point.

17. The multi-band antenna of claim 16, wherein the second monopole-type element of the upper band and the first monopole-type element of the lower band have a shared supply point on the first side of the multi-band antenna.

18. The multi-band antenna of claim 11, wherein the parasitic element is divided at a connection point of a short-circuit conductor into a first branch and a second branch.

19. The multi-band antenna of claim 18, wherein the first and second branches of the parasitic element are disposed on a third and a fourth side of the multi-band antenna.

20. The multi-band antenna of claim 19, wherein a first resonance frequency of the lower band is defined by a length of the short-circuit conductor, and a second resonance frequency of the upper band is defined by a total length of the parasitic element.

21. The multi-band antenna of claim 20, wherein the resonance of the lower band comprises a quarter-wave resonance, and the resonance of the upper band comprises a half-wave resonance.

22. A radio device (RD), comprising:

at least one internal multi-band antenna comprising at least a first and a second functional band, the at least one internal multi-band antenna comprising a first monopole-type element configured to radiate on a lower frequency band and a second monopole-type element configured to radiate on an upper frequency band; and a parasitic element electromagnetically coupled to the first and second monopole-type elements, the first and second monopole-type elements being coupled to at least one supply point connected to an antenna port of the radio device, the parasitic element being coupled from a short-circuit point to a ground plane of the radio device;

wherein the first monopole-type element of the lower frequency band is arranged to be supplied from the at least one supply point connected to the antenna port, the first monopole-type element together with other parts of the multi-band antenna comprising a first resonator, a natural frequency of the first resonator being in the lower frequency band;

wherein the second monopole-type element of the upper frequency band is arranged to be supplied from the at least one supply point connected to the antenna port, the second monopole-type element comprising a second resonator, a natural frequency of the second resonator being in the upper frequency band;

wherein the parasitic element is grounded only from a connecting point to the ground plane of the radio device, the parasitic element together with the other parts of the multi-band antenna comprising a third resonator;

wherein both the lower frequency band and the upper frequency band have two resonance locations in order to widen the first and the second functional band, respectively, the resonance location associated with the lower frequency band being caused by the parasitic element and the resonance location associated with the upper frequency band being caused by the first and second monopole-type elements; and wherein the parasitic element comprises a U-shape, a bottom part of the U-shape is on a side comprising a first outer end of the radio device, and the parasitic element is divided at a connection point of a short-circuit conductor into a first branch and a second branch, arms of the first and second branches of the parasitic element being on a third and a fourth side of the radio device.

23. The radio device of claim 22, wherein the at least one internal multi-band antenna comprises two parallel mounted multiband antenna components configured to comprise a diversity antenna system.

* * * * *